US005765338A

United States Patent [19]

Tsai

[11] Patent Number: 5,765,338

[45] Date of Patent: Jun. 16, 1998

[54] PACKAGE BAG EXPANDING DEVICE

[76] Inventor: Hung-Wen Tsai, No. 335, Chung Min Rd., North District, Taichung, Taiwan

[21] Appl. No.: 906,099

[22] Filed: Aug. 5, 1997

[51] Int. Cl.[6] ..... B65B 43/14

[52] U.S. Cl. ..... 53/572; 53/384.1; 53/390

[58] Field of Search ..... 53/384.1, 572, 53/390, 570, 571, 255, 258; 248/98, 99, 100

[56] References Cited

U.S. PATENT DOCUMENTS

| | | | |
|---|---|---|---|
| 2,759,648 | 8/1956 | Piazze | 53/384.1 |
| 3,491,514 | 1/1970 | Burford | 53/572 |
| 3,740,922 | 6/1973 | Liou | 53/390 |
| 5,440,863 | 8/1995 | Toya | 53/571 |
| 5,551,219 | 9/1996 | Wei | 53/572 |
| 5,655,352 | 8/1997 | Murakami | 53/384.1 |
| 5,657,619 | 8/1997 | Fujikawa | 53/570 |

FOREIGN PATENT DOCUMENTS

| | | | |
|---|---|---|---|
| WO 94/14660 | 7/1994 | WIPO | 53/572 |

*Primary Examiner*—John Sipos
*Assistant Examiner*—Jim Calve
*Attorney, Agent, or Firm*—Morton J. Rosenberg; David I. Klein; Jun Y. Lee

[57] ABSTRACT

A package bag expanding device includes a box and a pivotable cover which has a hole defined therethrough. A frame includes two first rods and a second rod respectively extending laterally therefrom. At least one package bag has two holes defined therethrough, a recess defined in an upper edge thereof and an opening defined therein below the holes. The two first rods extend through the two holes and the second rod is received in the recess. A pressing mechanism is fixedly disposed to one of two side walls of the box and includes an arm pivotally connected thereto which has a distal end rested on a periphery defining the opening of the package bag.

7 Claims, 11 Drawing Sheets

PACKAGE BAG EXPANDING DEVICE

BACKGROUND OF THE INVENTION

1. Field of the Invention

The present invention relates to a package bag expanding device and, more particularly, to such a device having a frame with two first rods and a second rod extending from the frame so that a pad of package bags for umbrellas is easily and correctly mounted to the two first rods and the second rod.

2. Brief Description of the Prior Art

In order to provide bags to customers to receive their wet umbrellas in a rainy day, a package bag expanding device is designed and provided. A package bag expanding device known to Applicant is a U.S. Pat. No. 5,551,219, entitled as "Package Bag Expanding Device" to Yao-ming Wei. In such an expanding device, referring to FIG. 1, the package bags 30 are detachably disposed to a frame 40 and each of the package bags 30 has a first hole 31, a second hole 32 and a third hole 33 respectively defined through an upper portion thereof. The frame 40 has a first rod 41 and a second rod 42 respectively extending transversely therefrom so that the first rod 41 extends through the first holes 31 and the second rod 42 extends through the second holes 32 of the package bags 30. A wire 35 extends through the third holes 33 of the package bags 30 and securely ties the package bags 30 together such that the package bags 30 will not be separated from each other when transported. Each periphery defining the first hole 31 and the second hole 32 has a slit 310/320 defined therefrom and extending upwardly therefrom so that the package bags 30 can be detached from the two rods 41, 42 easily. The package bags 30 each have an opening 34 defined therein and located below the first, the second and the third holes 31, 32 and 33. In order to correctly dispose the package bags 30 to the frame 40, the first rod 41 has a diameter larger than that of the second rod 42, and the first holes 31 and the second holes 32 respectively have different diameters corresponding to the first rod 41 and the second rod 42 so that when the package bags 30 are correctly disposed to the two rods 41, 42, the opening 34 will face to a direction opposite to the frame 40.

However, it is found that when disposing the package bags 30 to the frame 40, the operators often handle the package bags 30 incorrectly to extend the first rod 41 into the second holes 32 of the package bags 30 because there have no suitable instructions to tell the operators easily and correctly disposing the package bags to the frame. When the operators find the first rod 41 has a larger diameter than that of the second holes 32, some package bags 30 have been torn from the slits 320 and cannot be positioned relative to the frame 40.

The present invention intends to provide an improved package bag expanding device to mitigate and/or obviate the above-mentioned problem.

SUMMARY OF THE INVENTION

In accordance with one aspect of the present invention, there is provided a package bag expanding device comprising a box and a pivotable cover through which a hole is defined. A frame is connected transversely to the box and comprises a plate from which two first rods and a second rod respectively extend laterally therefrom. At least one package bag has two holes defined therethrough for the two first rods extending therethrough and a recess defined in an upper edge thereof for the second rod being received therein. A pressing mechanism is fixedly disposed to one of two side walls of the box and comprises an arm pivotally connected thereto which has a distal end rested on a periphery defining an opening of the package bag wherein the opening is defined below the holes.

It is an object of the present invention to provide a device for expanding package bags wherein the package bags each have a recess defined in an upper edge thereof and the recesses will tell an operator if the package bags to be disposed to the frame are in a wrong direction.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
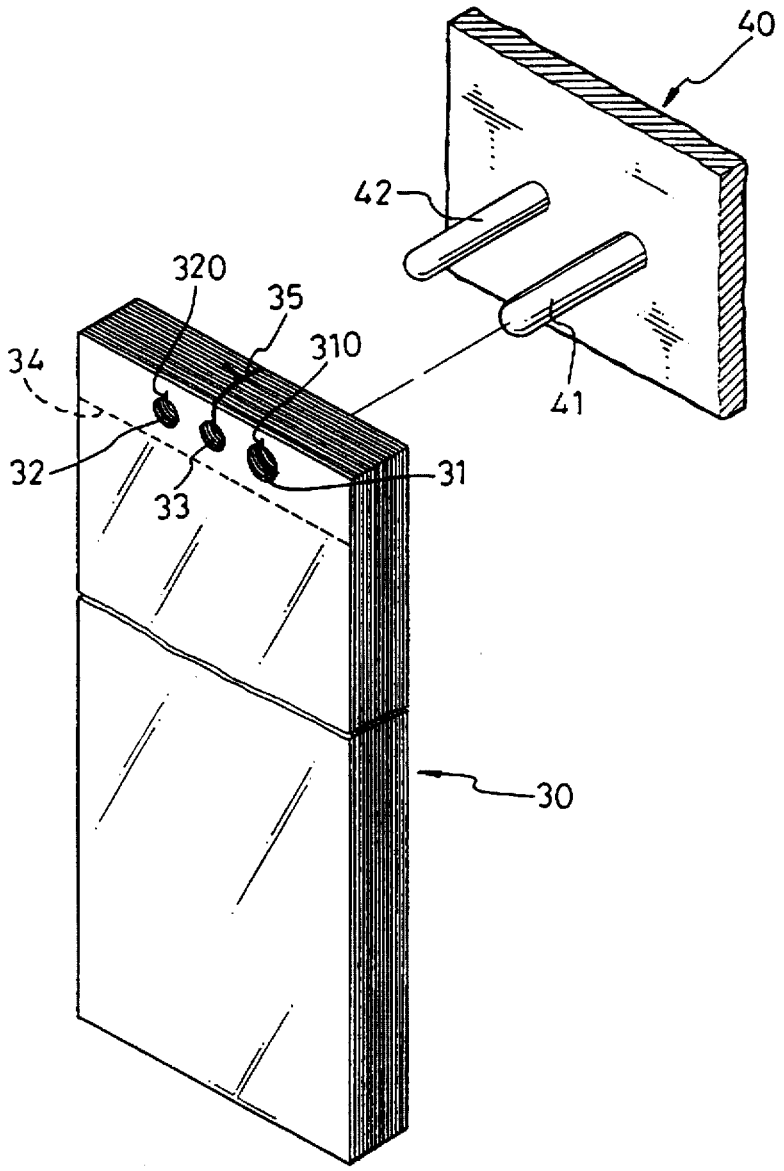
FIG. 1 PRIOR ART
FIG. 1 is an exploded view of a conventional frame and a pad of conventional package bags.
Figure 2:
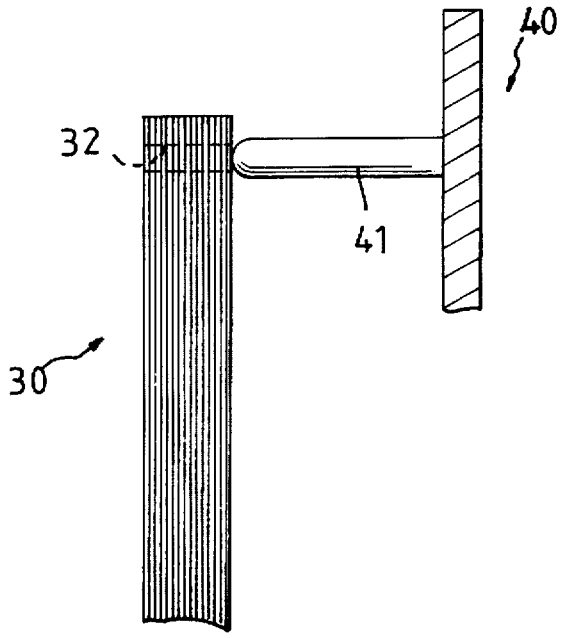
FIG.2 PRIOR ART
FIG. 2 is a side elevational view, partly in section, to show when the pad of package bags to be disposed to the frame as shown in FIG. 1 is in a wrong direction.

Referring to the drawings and initially to FIGS. 3 through 6, a package bag expanding device in accordance with the present invention includes a body 50 and a cover 51 pivotally connected to a rear wall of the body 50 wherein the cover 51 has a hole 510 defined therethrough so as to allow an umbrella (not shown) inserted therethrough and a locking member 511 disposed to a front edge thereof so that when the cover 51 is mounted to a top of the box 50, the locking member 511 is engaged with a corresponding locking member 512 disposed on the box 50. A frame in accordance with the present invention is transversely connected between a front wall and the rear wall of the box 50 and generally includes a plate 20 from which two first rods 21 and a second rod 22 respectively extend laterally therefrom wherein the second rod 22 is located higher than the two first rods 21. Two guide rods 53, 54 are respectively connected between the plate 20 and one of two opposite sides of the box 50 so as to allow a pressing member 55 to be slidably mounted on the two guide rods 53, 54. The pressing member 55 has three holes 550 defined therethrough and are respectively in alignment with the two first rods 21 and the second rod 22 of the plate 20. An extending portion 555 extends from one of two ends of said pressing plate 55 and has a hole defined therethrough for the guide rods 54 extending therethrough. A protrusion 551 extends from said extending portion 555, and three blocks 501 and a pulley 502 are respectively disposed to an inner side of the front wall so that a resilient cable 552 has a first end thereof connected to the protrusion 551 and a second end thereof extending around the pulley 502 to connect to one of two ends of a spring 553, the other end thereof fixedly connected to one of the blocks 501. The guide rod 53 has a recess 531 defined therein and located opposite to the plate 20 so that the other end of the pressing member 55 can be engaged with the recess 531 to be positioned. A board 554 extends from the end of the pressing member 55, which is engaged with the recess 531, so that the pressing member 55 can be lifted by lifting the board 554.

A pad of package bags 10, wherein each of the package bags 10 has two holes 11 defined therethrough for the two first rods 21 extending therethrough and a recess 12 defined in an upper edge thereof for the second rod 22 being received therein. Each of the package bags 10 has a second hole 13 defined therethrough and located between the two holes 11 so that a fastening member such as a wire 15 extends through the second holes 13 and securely ties the pad of package bags 10. An opening 14 is defined in each of the package bags 10 and is located below the holes 11.

Accordingly, when the pad of the package bags 10 is correctly disposed to the frame, the recesses 12 are in alignment with the second rod 22 so that an operator (not shown) easily mounts the pad of package bags 10 to the frame by extending the two first rods 21 through the two holes 11 and extending the second rod 22 through the recesses 12.

Figure 3:
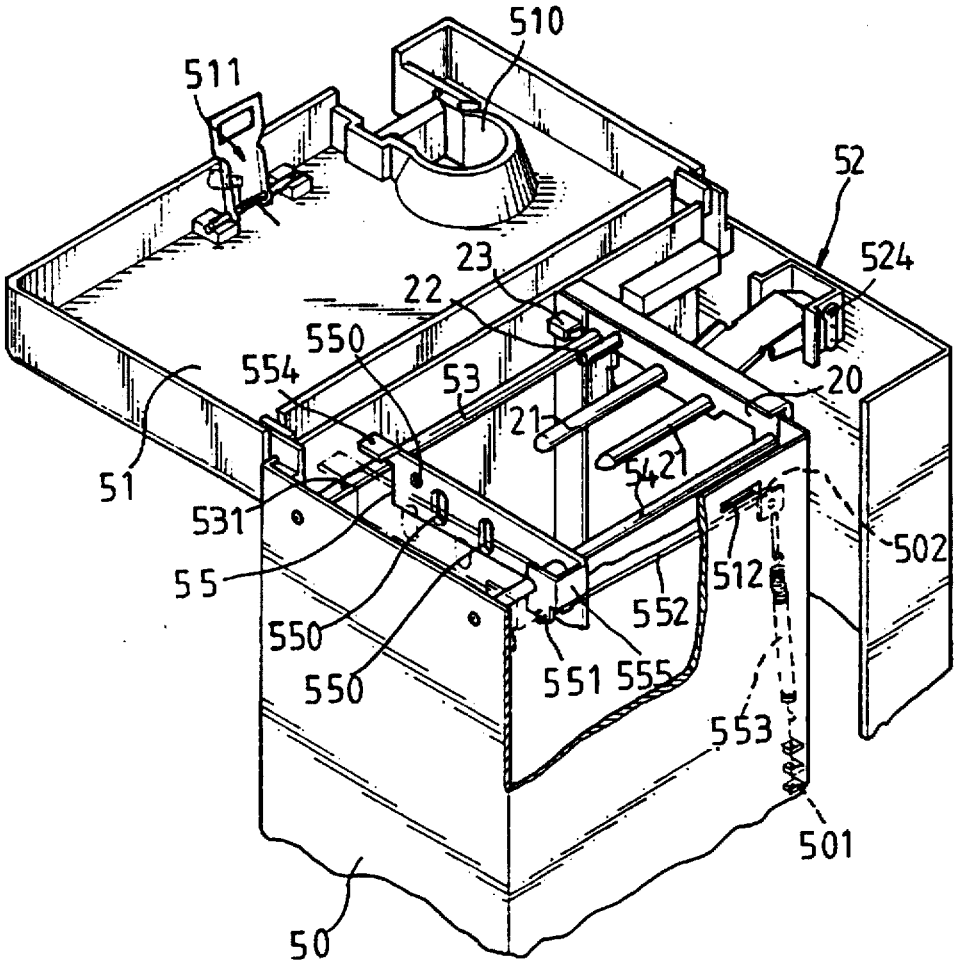
FIG. 3 is a perspective view of a package bag expanding device having a frame and package bags detachably disposed to the frame in accordance with the present invention.
Figure 3A:
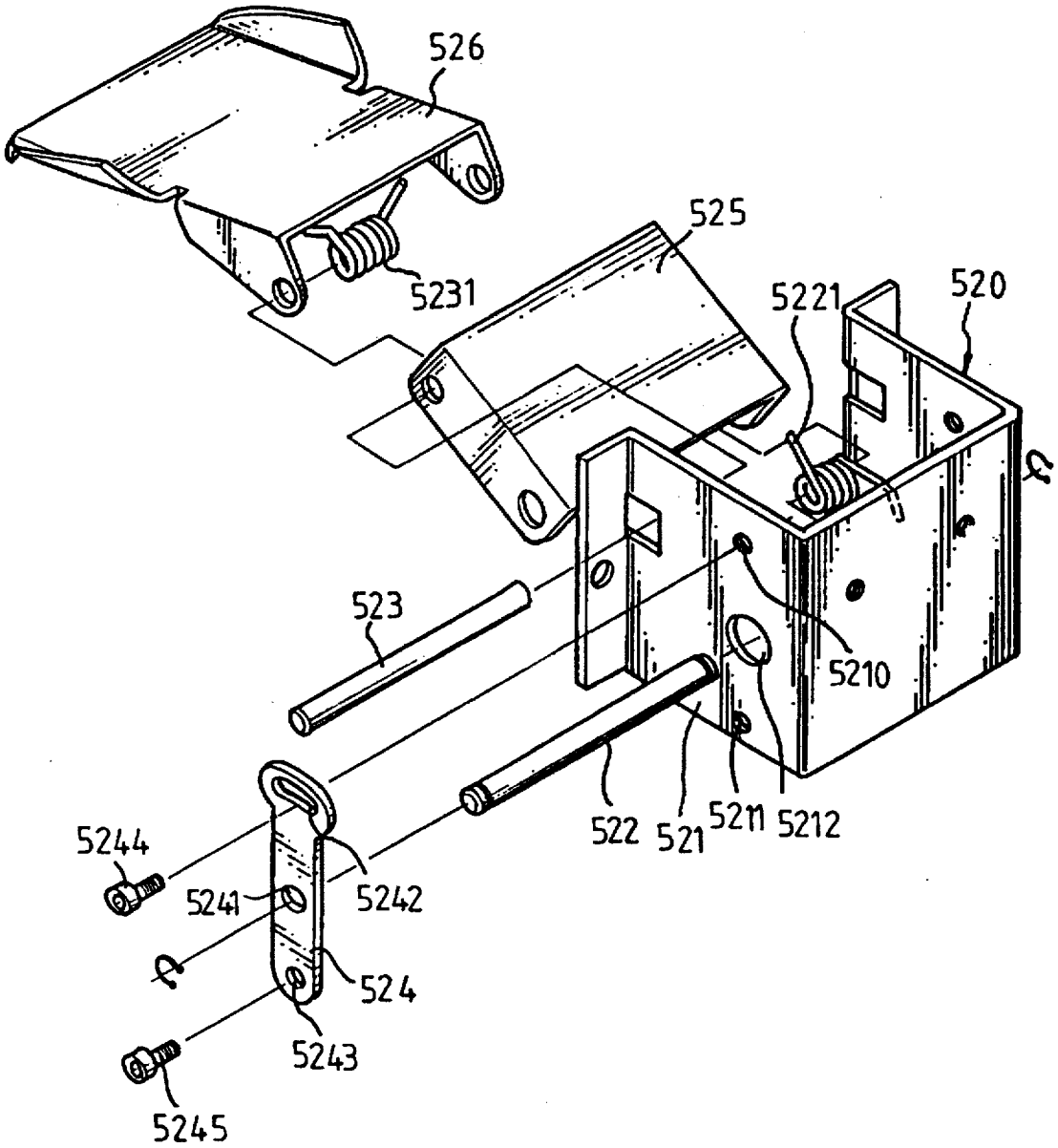
FIG. 3A is an exploded view of the pressing mechanism.

Referring to FIG. 3A, a pressing mechanism 52 is fixedly disposed to one of two side walls of the box 50 and comprises a bracket 520 fixedly connected to an inner side of the box 50 and having two extending plates 521, a first and a second pin 522, 523 extending through the two extending plates 521, an adjusting plate 524, a connecting board 525 pivotally connected to the first pin 522 and an arm 526 pivotally connected to the connecting board 525. Each of the two extending plates 521 has two threaded holes 5210, 5211 and a central hole 5212 respectively defined therethrough such that the first pin 522 extends through the central holes 5212 with a torsion spring 5221 and one end of the connecting board 525 pivotally connected to the first pin 522. The central hole 5212 has an inner diameter larger than an outer diameter of the first pin 522. The second pin 523 extends through the two extending plates 521 and the other end of the connecting board 525 with another torsion spring 5231 mounted thereto. The arm 526 is pivotally connected to the connecting board 525. The adjusting plate 524 has a hole 5241 defined therethrough so as to allow the first pin 522 to extend which is securely connected thereto by a C-clamp. An adjusting slot 5242 is defined in a top of the adjusting plate 524 and another hole 5243 is defined in a lower portion thereof so that the adjusting plate 524 is connected to the extending plate 521 by extending two bolts 5244, 5245 through the adjusting slot 5242 and the hole 5243 and threadedly engaged with the threaded holes 5210, 5211. The opening 14 of each of the package bags 10 is located to face to the pressing mechanism 52. The arm 526 has a distal end rested on a periphery defining the opening 14 of the first one of the package bags 10 so that when the umbrella (not shown) is inserted into the hole 510 defined in the cover 51 will push the arm 526 to open the opening 14 of the first package bag 10 so that the umbrella is received in the package bag 10.

Figure 3B:
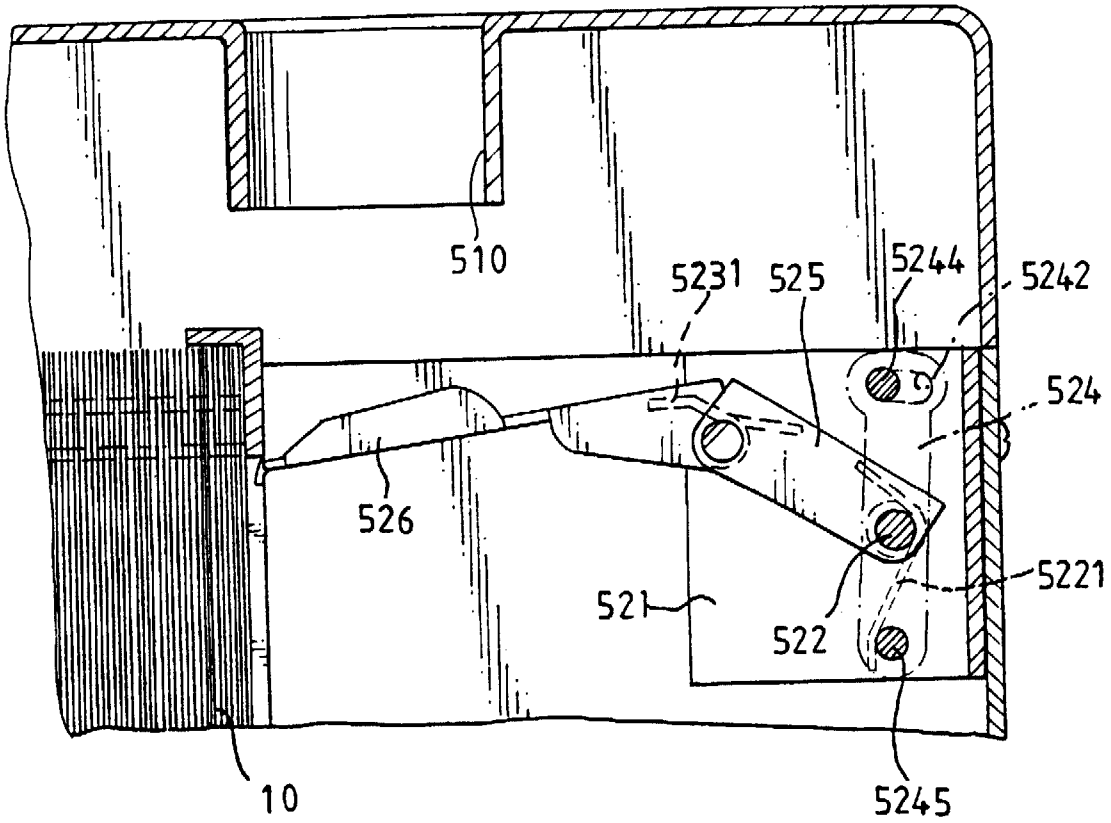
FIG. 3B is a side elevational view to show an adjusting plate is adjusted to move an arm of the pressing mechanism.
Figure 4:
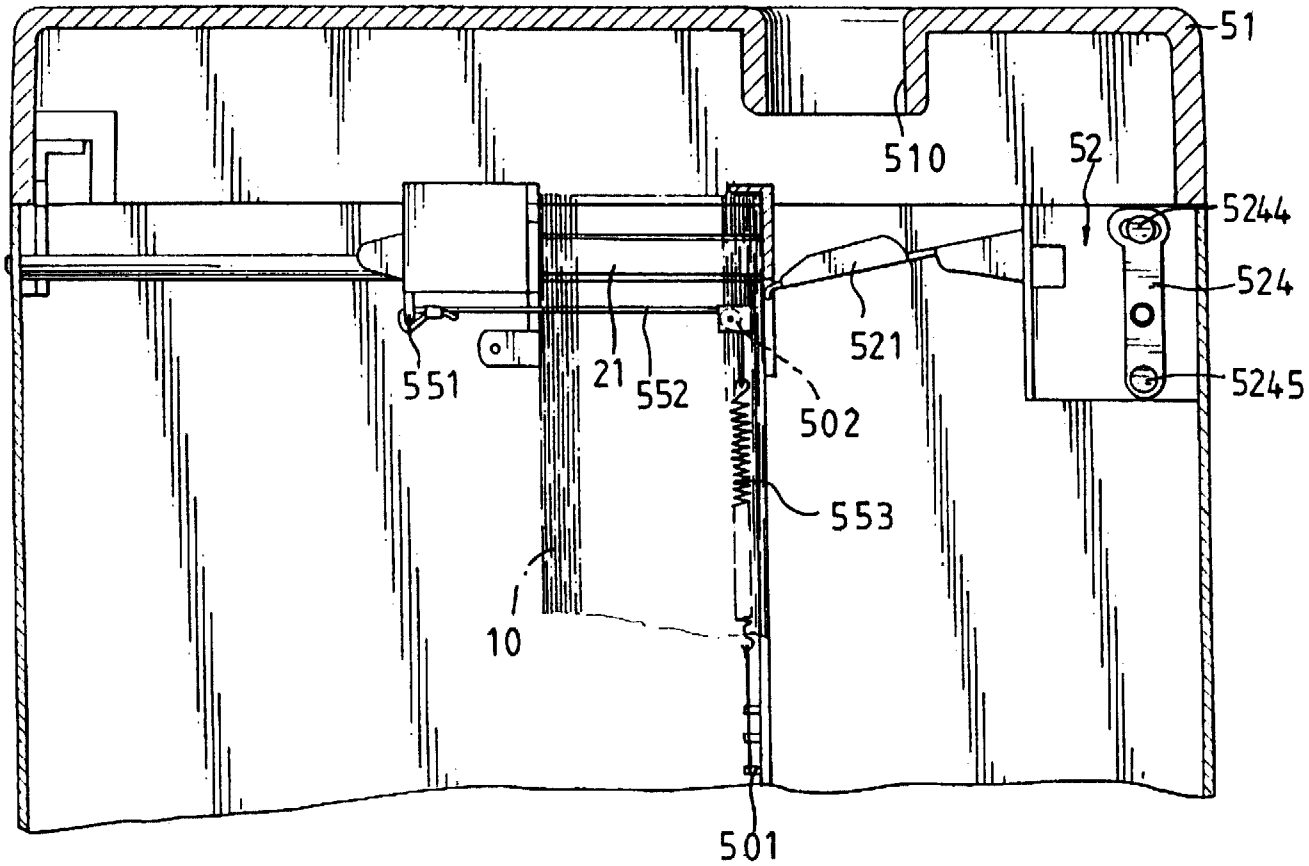
FIG. 4 is a side elevational view, partly in section, of the device in FIG. 3 to show a movable plate is biased to contact the package bags.
Figure 5:
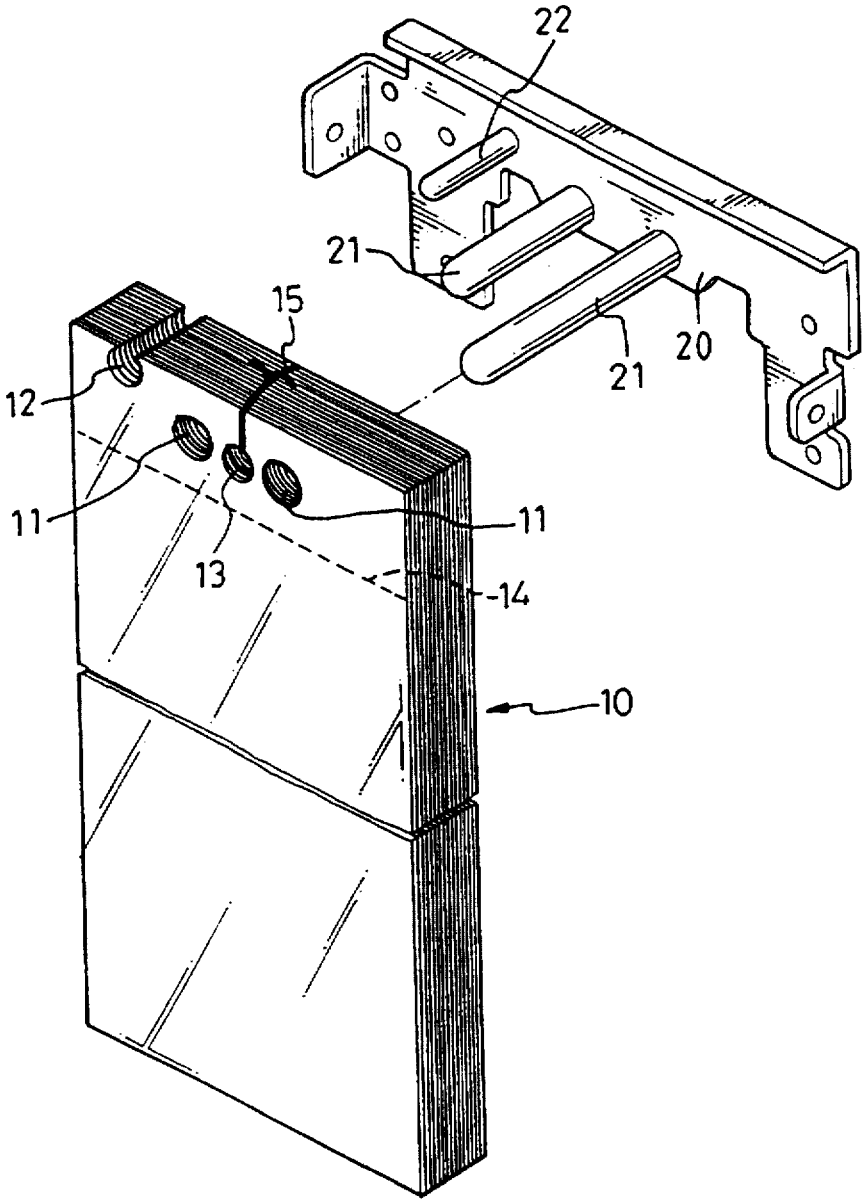
FIG. 5 is an exploded view of a frame and a pad of package bags in accordance with the present invention.
Figure 6:
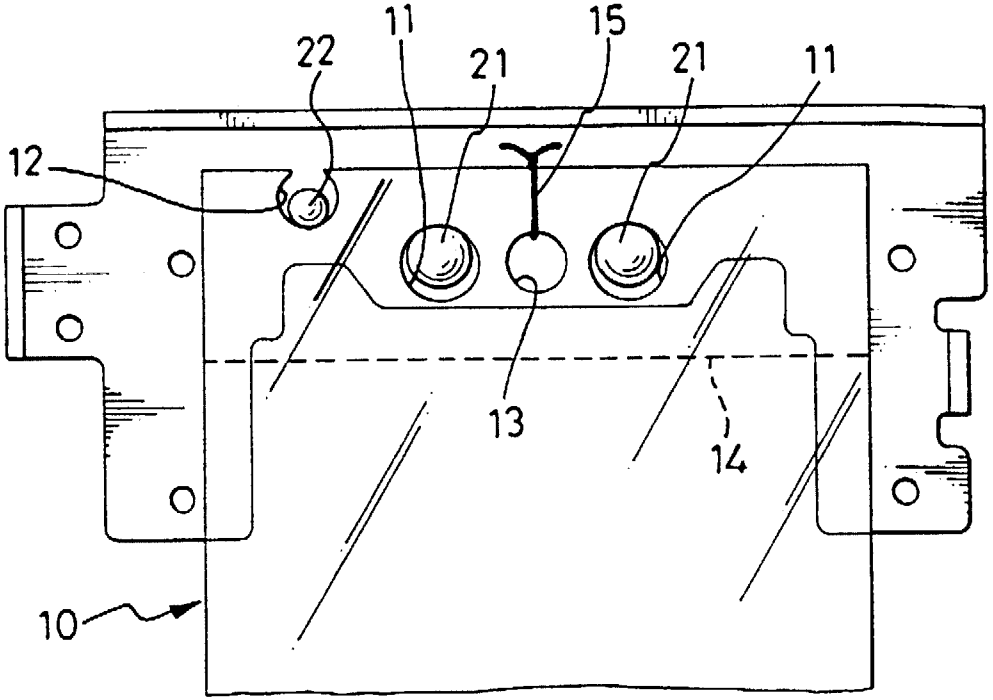
FIG. 6 is a plan view to show when the pad of package bags is disposed to the frame correctly.

Referring to FIG. 3B, the first pin 522 can be shifted within the central hole 5212 by firstly unfastening the bolt 5244 and secondly pivoting the adjusting plate 524 about the bolt 5245 so that the adjusting slot 5242 is moved, and the adjusting plate 524 is positioned by fastening the bolt 5244 again. Accordingly, the connecting board 525 and the arm 526 are moved toward the pad of the package bags 10. This may ensures that every package bag 10 can be normally expanded.

Figure 7:
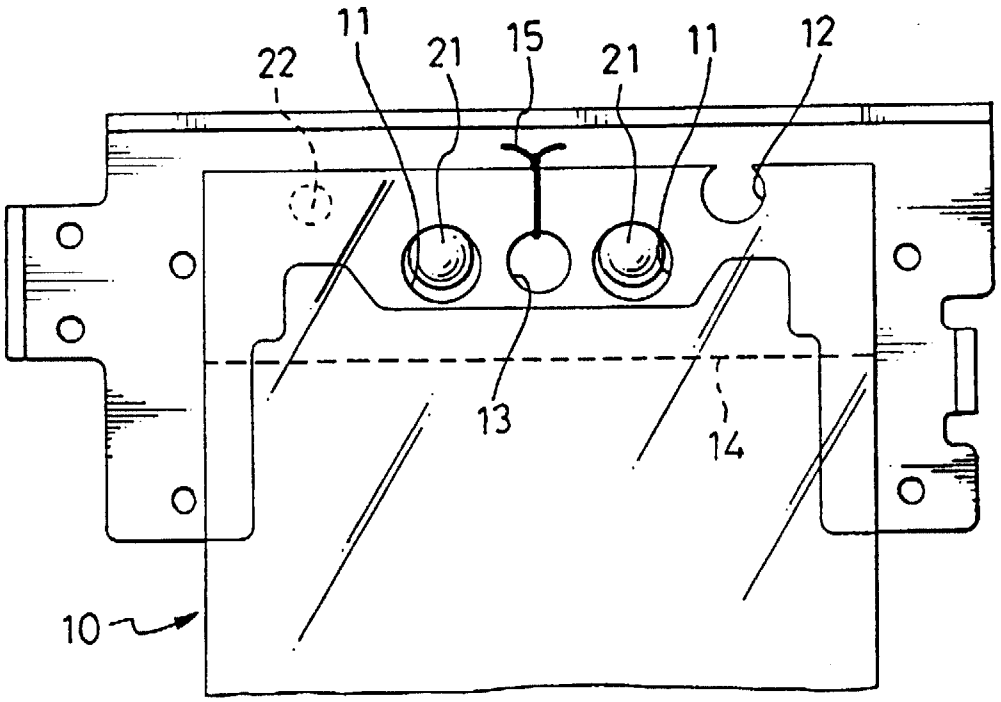
FIG. 7 is a plan view to show when the pad of package bags is disposed to the frame incorrectly.

Referring now to FIG. 7 if the operator handles the pad of package bags 10 in a wrong direction, he/she will find that the second rod 22 cannot extend through the pad of the package bags 10 because the recesses 12, at this moment, are located on the other side corresponding to the second rod 22. Therefore, the present invention can make sure that all the package bags 10 can be disposed to the frame correctly.

In practice, the pressing member 55 is pressed onto the package bags 10 under the resilient cable 552 and the spring 553 so that the package bags 10 are positioned thereby. When the pad of package bags 10 is used so that a thickness of the pad of the package bags 10 is thinner, the pressing member 55 then approaches to the plate 20 with the two first rods 21 and the second rod 22 of the plate 20 inserted into the three holes 550 of the pressing member 55. A limit switch 23 is disposed to one of two ends of the plate 20 so that when the pressing member 55 contacts the limit switch 23, a signal or the like is sent to notify a related person to add the package bags 10.

Figure 8:
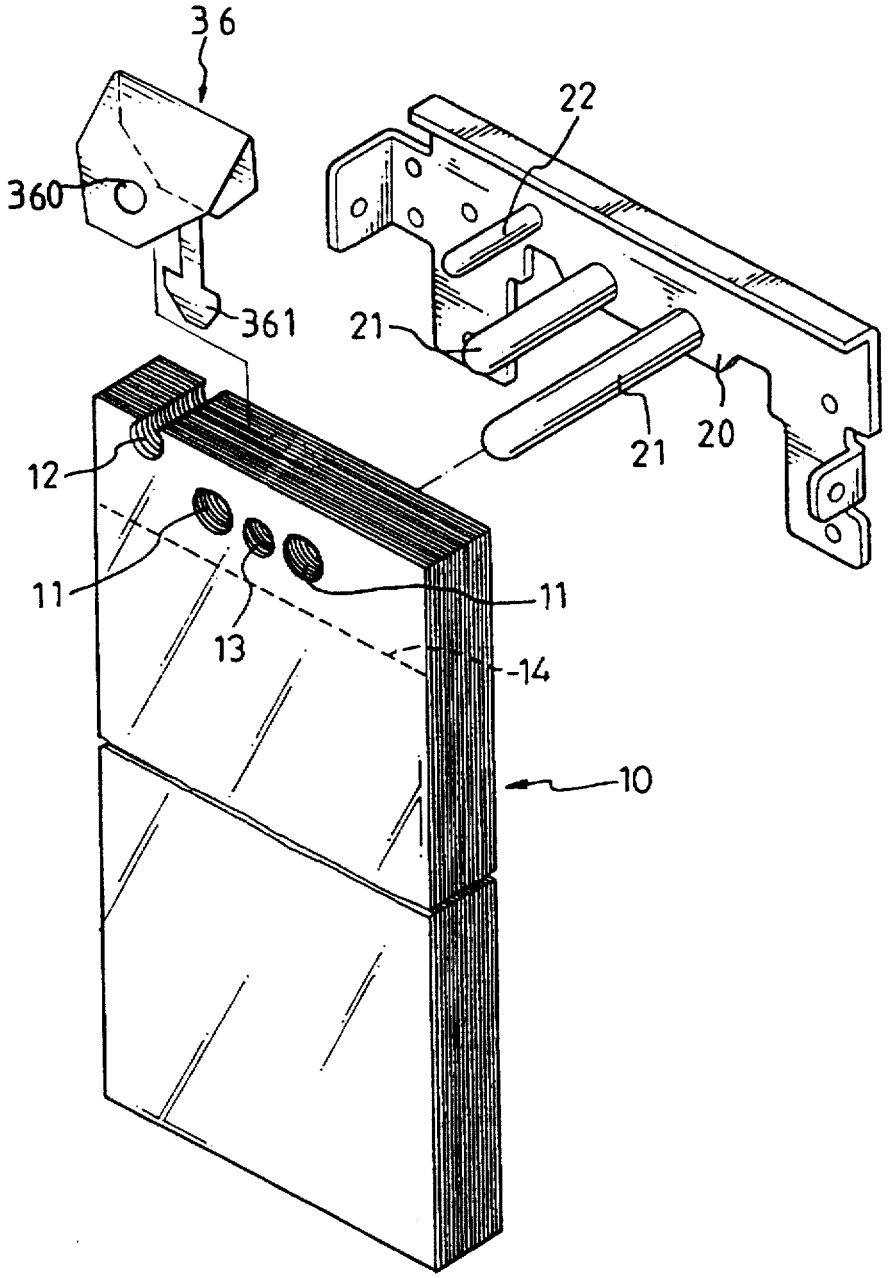
FIG. 8 is an exploded view to show another embodiment of the fastening member and the pad of package bags.
Figure 9:
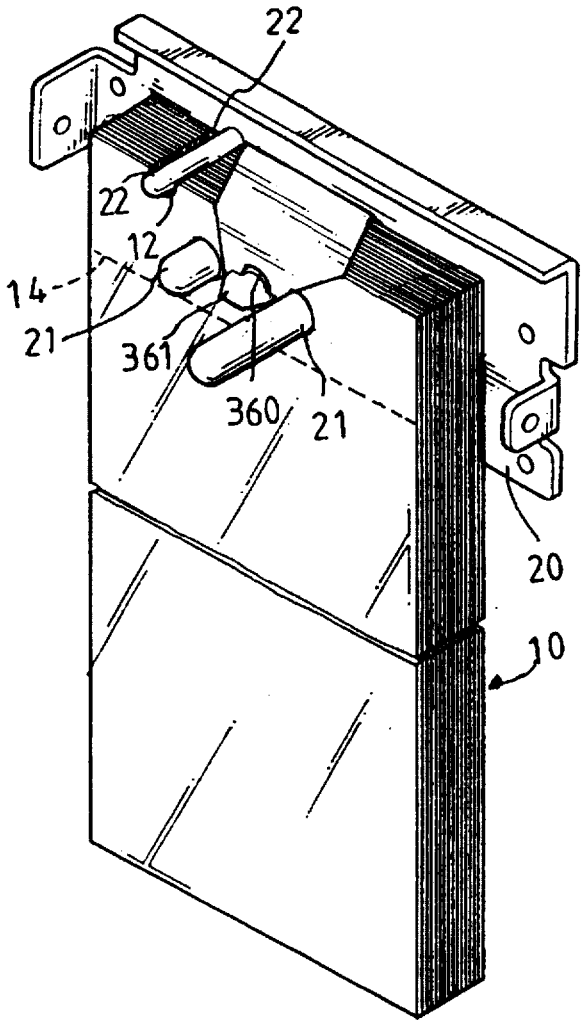
FIG. 9 is a perspective view to show the pad of package bags is fastened by the fastening member shown in FIG. 8.

Referring to FIGS. 8 and 9, another embodiment of the fastening member is an inverted U-shaped member 36 which has one distal end thereof with an aperture 360 defined therethrough and the other end thereof with a hook member 361 extending therefrom so that the U-shaped member 36 is securely mounted to the pad of the package bags 10 and the hook member 361 extends through the second hole 13 and the aperture 360.

Although the invention has been explained in relation to its preferred embodiment, it is to be understood that many other possible modifications and variations can be made without departing from the spirit and scope of the invention as hereinafter claimed.

What is claimed is:

1. A package bag expanding device comprising: a box with a front wall, two opposite side walls, and a rear wall, and a cover pivotally connected to a rear wall of said box wherein said cover having a hole defined therethrough;

a frame connected between said front wall and said rear wall of said box and comprising a plate from which two first rods and a second rod respectively extend laterally therefrom;

at least one package bag having two first holes defined therethrough for said two first rods extending therethrough and a recess defined in an upper edge thereof for said second rod being received therein, an opening defined in said package bag and located below said two first holes, and a pressing mechanism fixedly disposed to one of two side walls of said box and comprising a bracket having two extending plates, a first and a second pin respectively extending through said two extending plates, an adjusting plate connected to one of said extending plates, a connecting board pivotally connected to said first pin and an arm pivotally connected to said connecting board, each of said two extending plates having two threaded holes and a central hole respectively defined therethrough such that said first pin extends through said central holes with a torsion spring and one end of said connecting board pivotally mounted to said first pin, said central hole having an inner diameter larger than an outer diameter of said first pin, said second pin extending through said two extending plates and the other end of said connecting board with another torsion spring mounted thereto, said arm is pivotally connected to said connecting board and having a distal end rested on a periphery defining said opening of said package bag, said adjusting plate having a hole defined therethrough so as to allow said first pin to extend therethrough, said first pin fixedly connected to said adjusting plate, said adjusting plate having an adjusting slot defined in a top thereof and another hole defined in a lower portion thereof so that said adjusting plate is pivotally connected to said extending plate by extending two bolts respectively through said adjusting slot and said hole defined in said lower portion of said adjusting plate and threadedly engaging said two bolts with said two threaded holes of said extending plate.

2. The device as claimed in claim 1 wherein said package bag has a second hole defined therethrough and located between said two first holes thereof so that a fastening member extends therethrough.

3. The device as claimed in claim 2 wherein said fastening member is an inverted U-shaped member which has one distal end thereof with an aperture defined therethrough and the other end thereof with a hook member extending therefrom so that said hook member extends through said aperture.

4. The device as claimed in claim 1 wherein two guide rods are respectively connected between said plate and the other one of said two opposite side walls of said box, a pressing member slidably and biasedly mounted on said two guide rods, said pressing member having three holes defined therethrough and located respectively in alignment with said two first rods and said second rod of said plate.

5. The device as claimed in claim 4 wherein one of said two guide rods has a recess defined therein and is located opposite to said plate so that one end of said pressing member is disengagably engaged with said recess.

6. The device as claimed in claim 4 wherein a protrusion extends from one of two ends of said pressing member, at least one block and a pulley respectively disposed to said front wall, a resilient cable having a first end thereof connected to said protrusion and a second end thereof extending around said pulley to connect to one of two ends of a spring which has the other end thereof fixedly connected to said block.

7. The device as claimed in claim 6 wherein an extending portion extends from the other end of said pressing member and has a hole defined therethrough for one of said two guide rods extending therethrough, said protrusion extending from said extending portion.

* * * * *